US012005366B2

(12) United States Patent
Walser et al.

(10) Patent No.: US 12,005,366 B2
(45) Date of Patent: Jun. 11, 2024

(54) AMUSEMENT DEVICE FOR FAIRS, AMUSEMENT PARKS OR THE LIKE

(71) Applicants: Willy Walser, Murg (CH); Roman Rothe, Reichenburg (CH)

(72) Inventors: Willy Walser, Murg (CH); Roman Rothe, Reichenburg (CH)

( * ) Notice: Subject to any disclaimer, the term of this patent is extended or adjusted under 35 U.S.C. 154(b) by 267 days.

(21) Appl. No.: 17/579,295

(22) Filed: Jan. 19, 2022

(65) Prior Publication Data

US 2022/0226740 A1 Jul. 21, 2022

(30) Foreign Application Priority Data

Jan. 19, 2021 (EP) ..... 21152324

(51) Int. Cl.
*A63G 1/10* (2006.01)
*A63G 1/26* (2006.01)

(52) U.S. Cl.
CPC *A63G 1/10* (2013.01); *A63G 1/26* (2013.01)

(58) Field of Classification Search
CPC ... A63G 1/06; A63G 1/10; A63G 1/24; A63G 1/26
USPC ..... 472/29–45
See application file for complete search history.

(56) References Cited

U.S. PATENT DOCUMENTS 1,745,719 A 2/1930 Sellner
2,206,172 A * 7/1940 Estes ..... A63G 1/26 472/40
2,698,178 A * 12/1954 Williams ..... A63G 1/10 52/63
2,864,615 A * 12/1958 Castille ..... A63G 1/26 472/31

* cited by examiner

*Primary Examiner* — Kien T Nguyen
(74) *Attorney, Agent, or Firm* — Thomas M. Freiburger

(57) ABSTRACT

The invention relates to an amusement device for fairs, amusement parks or the like, having a substantially circular planar base (1) on which a star-shaped drive unit (3, 31) is arranged, which is rotatably mounted on a support bearing (5, 28) of the base (1), and at least one passenger gondola is arranged on each arm of the drive unit (3, 31). According to the invention, one or more of the passenger gondolas arranged on the arms (8, 32) are displaceable in the radial direction of the drive unit (3, 31) by means of pushing devices (15, 24) arranged to be displaceable each in the longitudinal direction of the arms (8, 32), the respective passenger gondolas being coupled to the respective pushing devices (15, 24), and the pushing devices (15, 24) follow a predetermined guide track (7, 14) when the drive unit (3, 31) rotates on the base (1), so that the passenger gondolas follow a circulation path on the base (1) which corresponds to the course of the guide track (7, 14).

20 Claims, 8 Drawing Sheets

AMUSEMENT DEVICE FOR FAIRS, AMUSEMENT PARKS OR THE LIKE

BACKGROUND OF THE INVENTION

Figure 1:
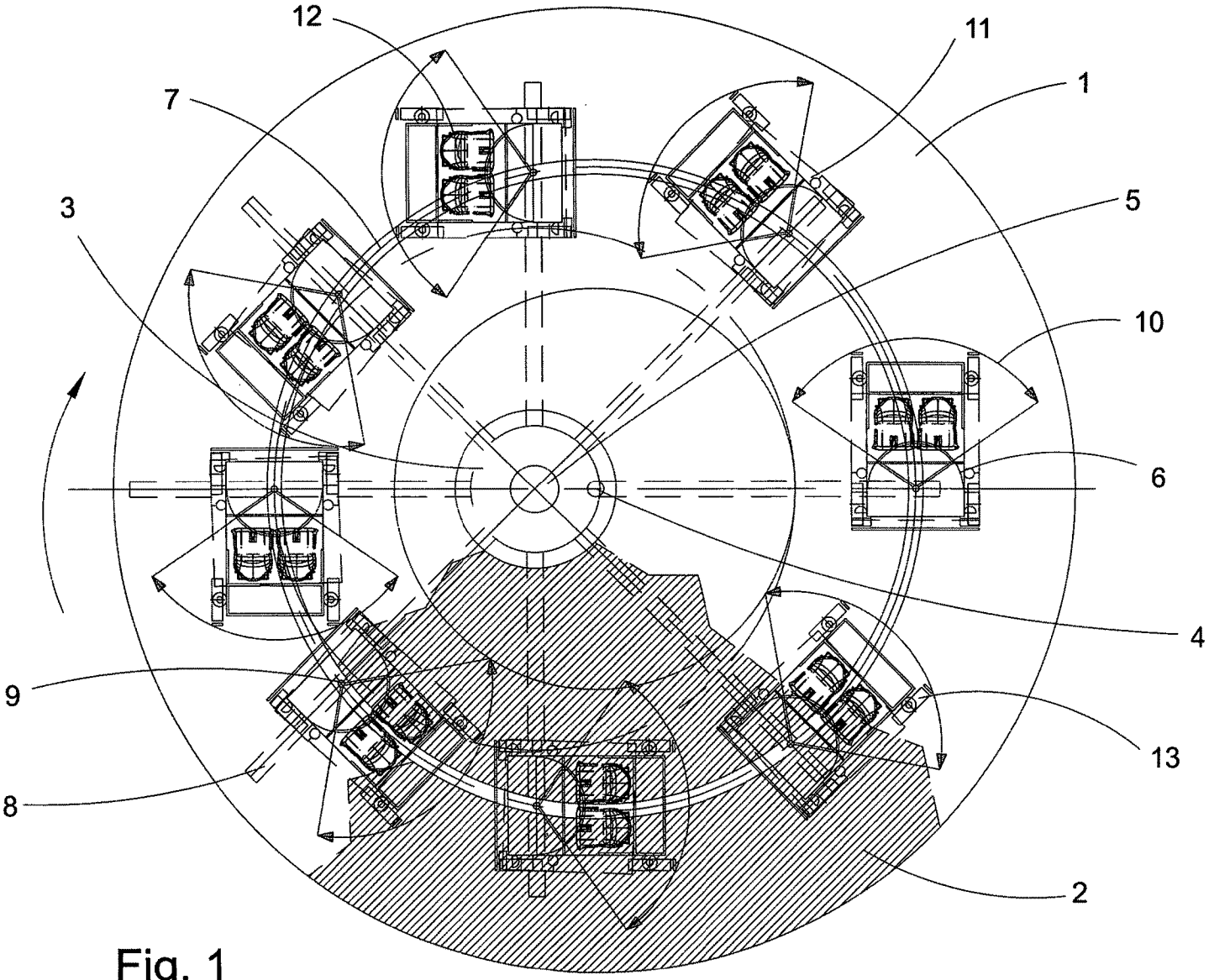

This application claims priority from European patent application number EP 21152324.6, filed Jan. 19, 2021.

The invention relates to an amusement device for fairs, amusement parks or the like having a substantially circular planar base on which is disposed a star-shaped drive unit rotatably mounted on a support bearing of the base, and on each arm of the drive unit is disposed a passenger gondola.

Such an amusement device can already be found in U.S. Pat. No. 1,745,719 from 1930, where a star-shaped drive unit is described, which carries gondolas at the respective ends of its arms, which rotate along a concentric path on the base and thereby perform a rotation of their own. However, the amusement effect involved is limited and relatively monotonous.

Nowadays operators of amusement devices at fairs are increasingly striving to make the motion of passenger gondolas as random or variable as possible, with unpredictable and interactive motion sequences in particular leading to enhanced amusement experiences. On the other hand, the audience to be addressed is of different ages and interests, so that devices for young people have to be designed differently than devices for small children and people who are not so interested in extreme effects or strong acceleration forces.

The invention is essentially aimed at the second-mentioned public, which, however, also expects that surprising elements can be experienced and that interactivity with the device is possible.

The invention is therefore based on the object of specifying an amusement device for fairs, amusement parks or the like, which offers a great amusement experience for the addressed public, which can be set up in a small space, is easy to control and allows a variable sequence of movements.

This object is accomplished by the invention indicated in claim 1. More advanced embodiments of the invention are stated in subclaims.

Based on the features of U.S. Pat. No. 1,745,719 disclosed in the preamble of claim 1, the invention provides that one or more of the passenger gondolas arranged on the arms are displaceable in the radial direction of the base by means of respective pushing devices arranged displaceably in the longitudinal direction of the arms. For radial displacement, the respective passenger gondola is coupled to the respective pushing device, wherein the pushing devices follow a predetermined guide track during rotating of the drive unit on a driving platform, so that the passenger gondolas follow a circulation path on the base which corresponds to the course of the guide track.

In a first embodiment, the passenger gondolas travel on the travel platform preferably on two wheels, wherein a third support point is formed by coupling with the pushing device, which rotates below the travel platform and is connected to the passenger gondola via a driver. The driver is guided by and follows a gap-shaped guide track formed in the ride platform as the drive unit orbits. Alternatively, the guide track may be formed by a track on the base which the pushing device follows as it orbits on the base.

In a second embodiment, the passenger gondolas float in a water basin and are likewise moved by arms of a drive unit.

The circulation path of the gondolas on the base depends on the selected course of the guide track. In a simple embodiment, the guide track runs concentrically to the base.

In more advanced embodiments it is circular, oval, triangular or irregular, whereby the star-shaped drive unit for the passenger gondolas is preferably mounted eccentrically on the base. The guide track thereby defines the circulation path of the gondolas on the base. The mutual distance of the passenger gondolas during circulation on the base changes if the bearing of the drive unit is arranged eccentrically to the guide track. As a result, the length of the virtual circular chords between two passenger gondolas varies more the further the bearing of the drive unit is spaced from the center of the base and the guide track is concentric with the center of the base. Furthermore the distance between two successive passenger gondolas increases when the pushing devices for the passenger gondolas on the arms are far from the center of the drive unit, while the length of the virtual circle chords decreases when the pushing devices are close to the center of the drive unit. Thus the passenger gondolas can be accelerated and decelerated during their orbit on the base.

Preferably, the passenger gondolas are coupled to the respective pushing device in a rotatable or free-running manner. By means of a control device, e.g. in the form of a steering wheel, the passengers can thus swivel or rotate the passenger gondolas relative to the pushing device.

For coupling the passenger gondolas with the respective pushing devices, the pushing devices are provided with preferably rod-shaped vertically directed drivers which reach through a rail-shaped guide gap and thus follow the course of the guide track. An upper end of the drivers can carry the steering wheel which can be operated by the passengers.

Instead of a static guide track, in a more advanced embodiment the invention provides for controlling the displacement of the pushing devices by means of pneumatic, hydraulic, chain, rack and pinion or electric drive. In this way, almost any pattern of movement of the passenger gondolas can be performed during the rotation of the drive unit. However, this requires that the arms of the drive unit are either located on the upper side of the ride platform or that the ride platform rotates with the drive unit, in which case the drivers are guided through gaps in the ride platform that run parallel to the arms.

The invention is not limited to passenger gondolas that ride on a ride platform. Rather, the invention is also advantageously applicable to an amusement device which is designed as a water basin in which the passenger gondolas are floatable. In this case, no fixed driving platform is required. The guide track can be formed by underwater rails. However, the pushing devices can also be actuated by the aforementioned active drives, in which case no statically formed guide track is required.

When active drives are used to move the pushing devices, the passenger gondolas can be moved to the rim of the water basin at the beginning of a ride or at its end to allow passengers to board and disembark without having to raise an underwater platform to allow passengers to board or disembark from passenger gondolas that are not at the rim of the basin.

In a further embodiment of the invention the arms of the drive unit may also be vertically pivotable in such a way that the outer ends of the arms are movable in a vertical direction by bearing on a vertically profiled path, so as to allow the passenger gondolas to follow an upward and downward path.

Instead of a single passenger gondola on an arm, two or more passenger gondolas may be associated with an arm by using a gondola frame to which the passenger gondolas are attached, the gondola frame being coupled to the pushing device.

The gondola frame is preferably pivotally or rotatably connected to the pushing device, so that the passengers can experience a rotational movement about the axis connecting the gondola frame to the pushing device during the ride. The rotation is preferably performed by means of a push rod arranged between a joint on the drive unit, for example an arm, and a joint on the gondola frame.

Furthermore, the individual passenger gondolas may also be rotatable relative to the gondola frame.

The gondolas of the gondola frame may further be slidably formed on the gondola frame by being coupled to displacement devices which run over the gondola frame, the diplacement devices being connected to arms of a drive unit which is rotatably arranged on the pushing device.

It may also be provided that the passenger gondolas are pivotable about a horizontal axis, so as to give passengers in a water basin the illusion of being in an actual boat, although there is a mechanical connection between the passenger gondola, pushing device and arm.

The invention is explained in more detail below with reference to examples of embodiments.

Figure 2:
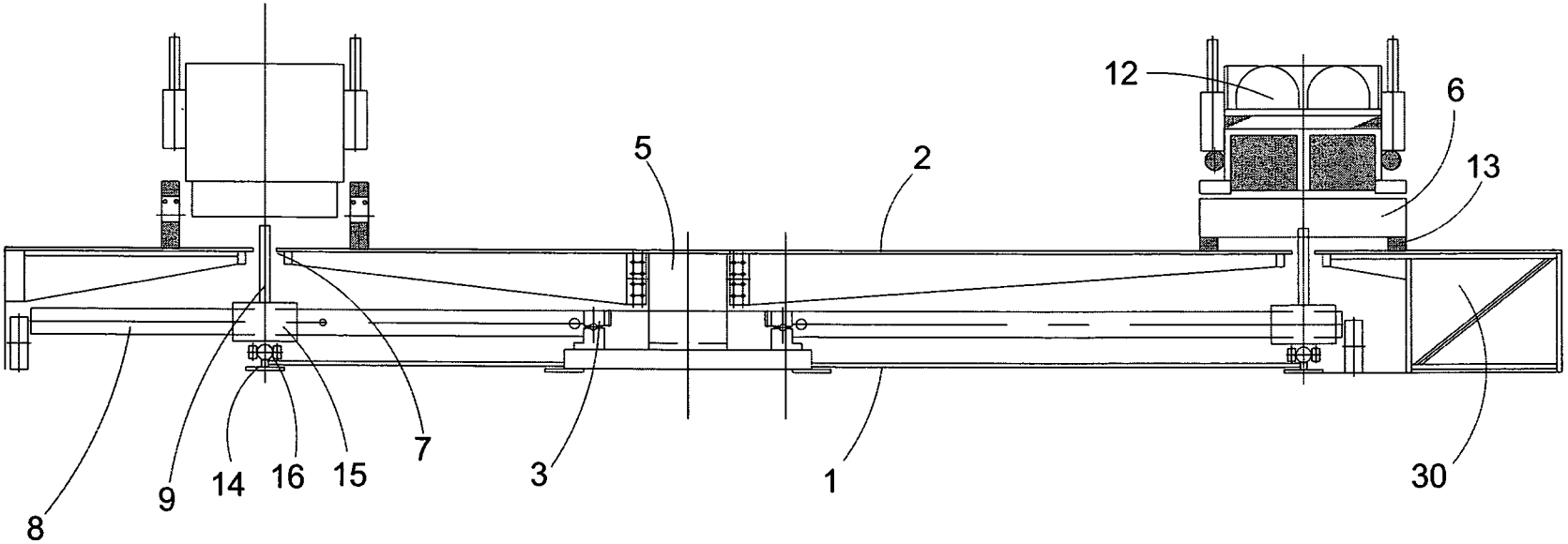
Figure 3:
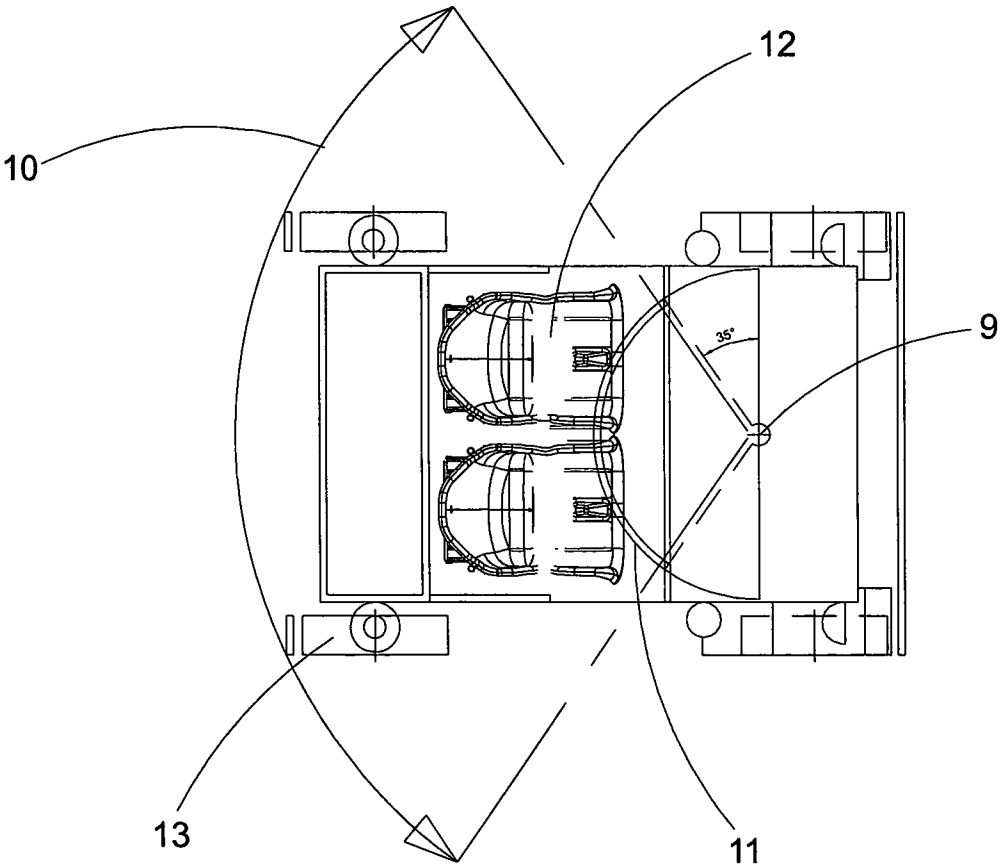
Figure 4:
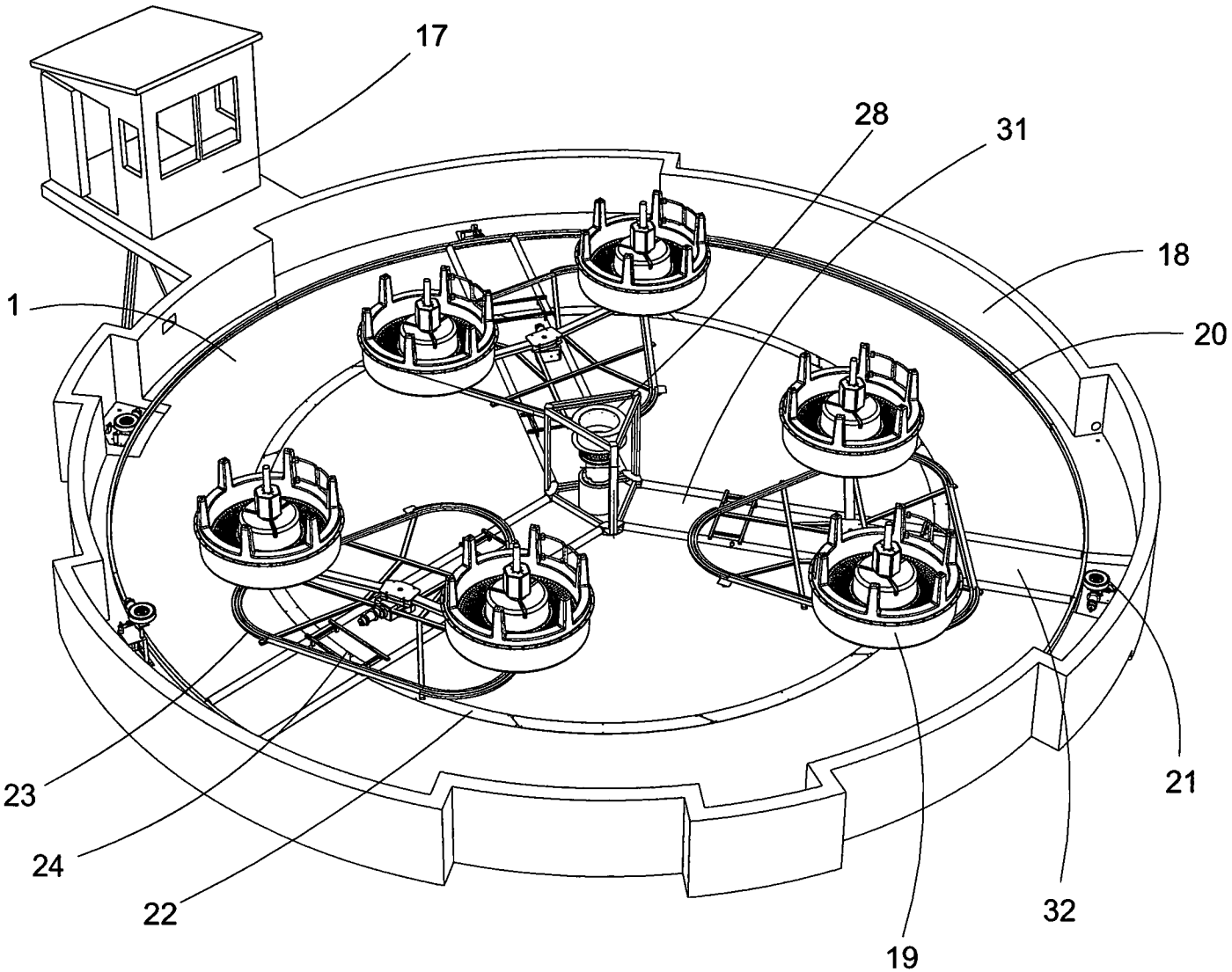
Figure 5:
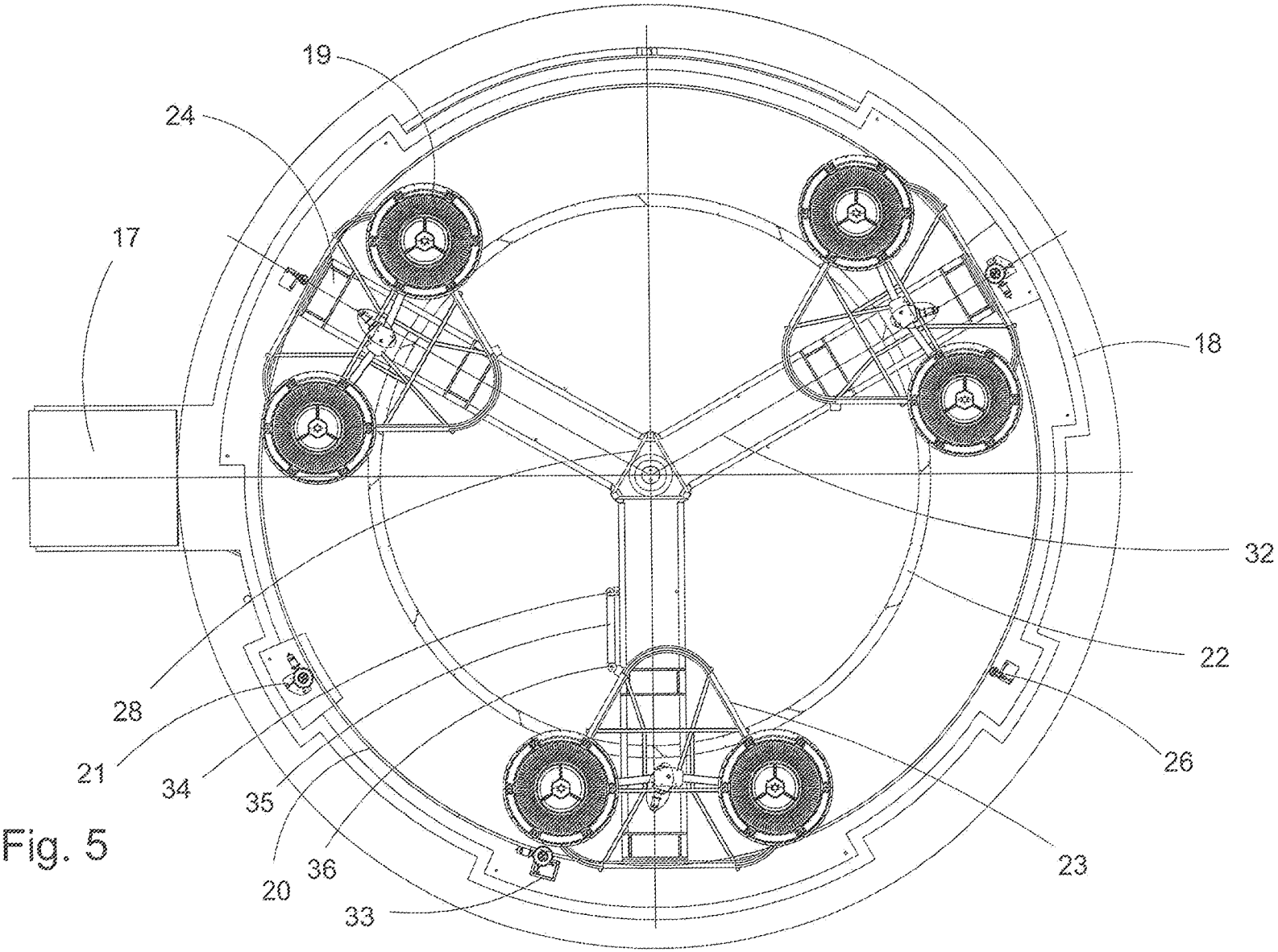
Figure 6:
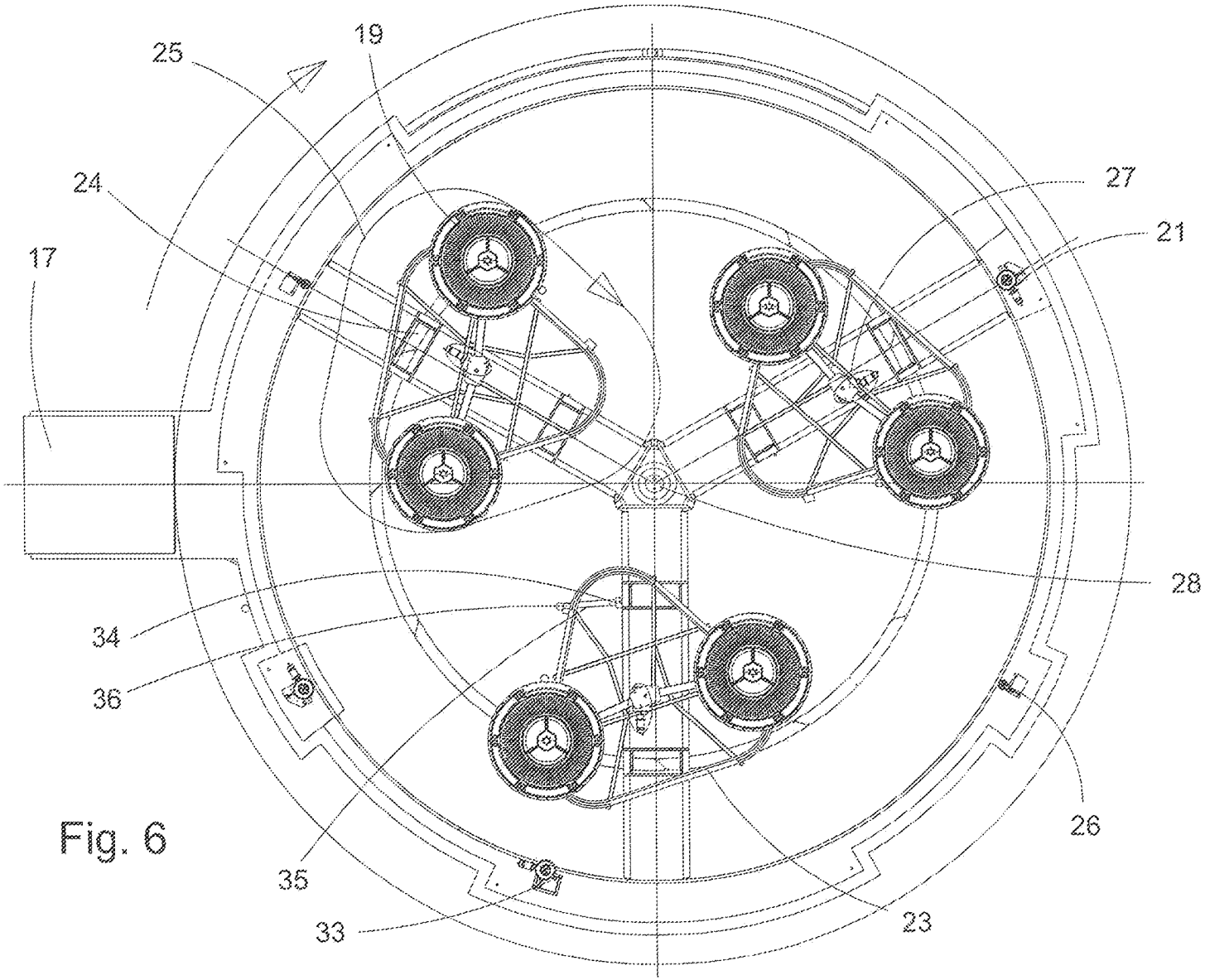
Figure 7:
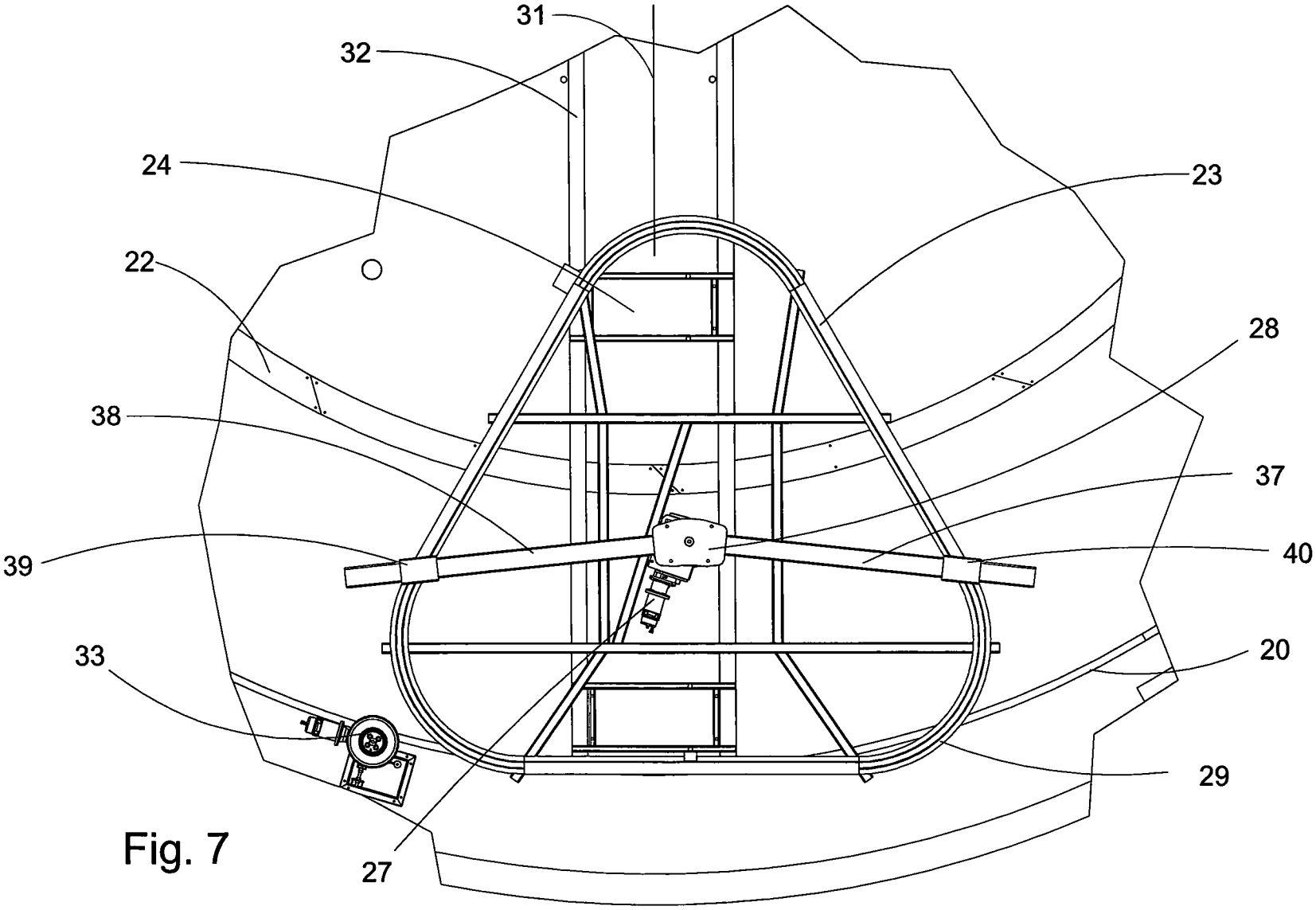
Figure 8:
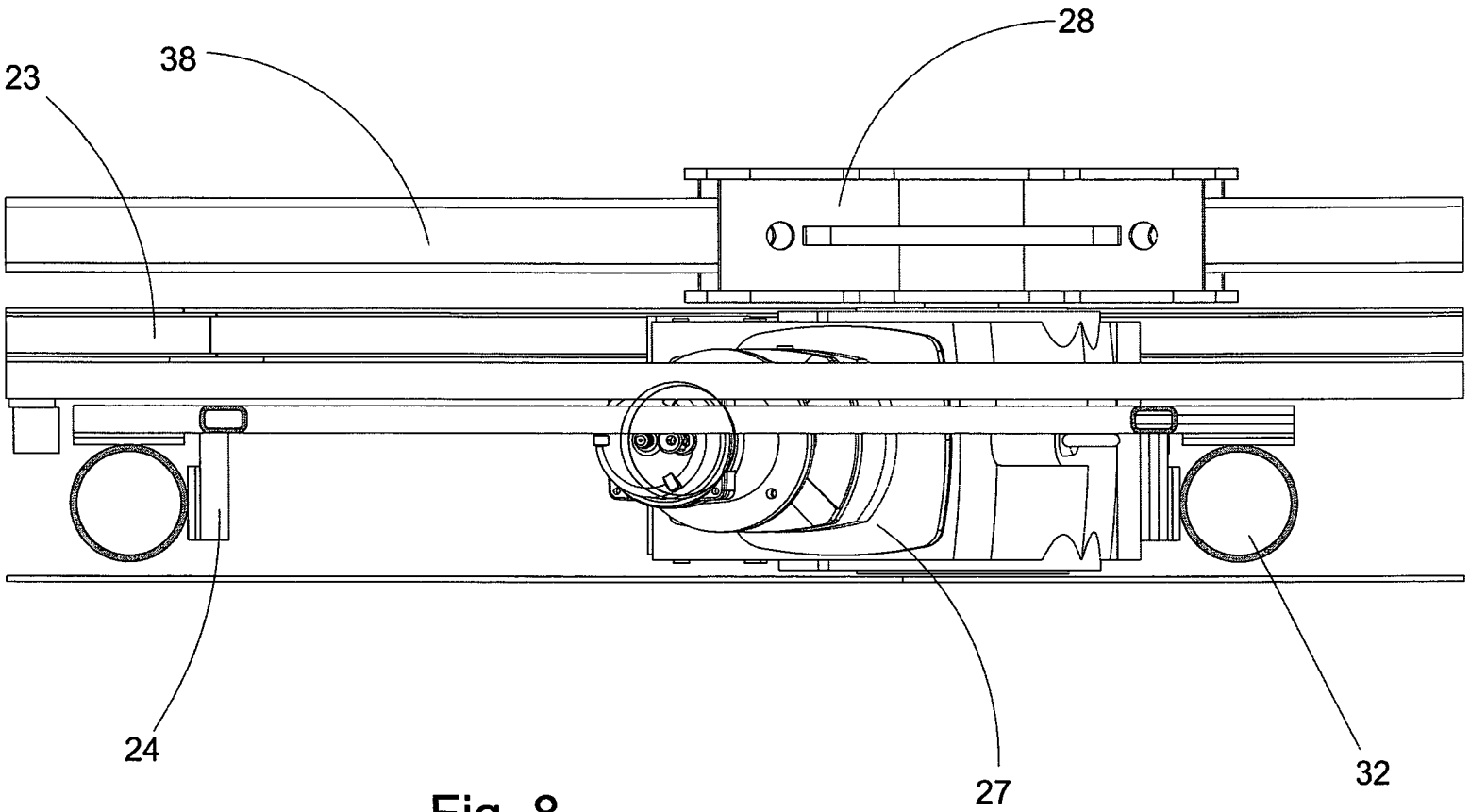

The figures show the following:

FIG. 1 a top view of an amusement device of a first embodiment of the invention, in which the guide track is circular, FIG. 2 a sectional view of the representation of FIG. 1, FIG. 3 a top view of a vehicle, FIG. 4 a perspective view of an amusement device of a second embodiment of the invention, FIG. 5 a top view of an amusement device of the second embodiment of the invention in a loading position, FIG. 6 a top view of an amusement device of the second embodiment of the invention in an operating position, FIG. 7 a view of a gondola frame, and FIG. 8 a view of a gondola drive.

The amusement device according to the invention is a circularly shaped device which is substantially in the form of a revolving ride. Passenger gondolas in the form of vehicles move on a platform or boats in a basin along a course which is substantially circular in its basic shape.

In the first embodiment shown in FIG. 1, a number of vehicles 6, each provided with two seats 12, are shown travelling in a circle on a platform 2 extending above and parallel to the base 1. Between the base 1 and the platform 2 there is a drive unit 3, which is rotatably mounted eccentrically from the base centre 4 in a support bearing 5. The drive unit 3 has a of radially directed arms 8 extending below the platform 2 from the support bearing 5 to near the outer rim of the base 1. On each arm 8 of the drive unit 3, a pushing device 15 (FIG. 2) is slidably arranged in the longitudinal direction of the arms. Each pushing device 15 is provided with a rod-shaped vertically directed driver 9. All the drivers 9 of the pushing devices 15 arranged on the arms project through a guide gap 7 formed in the platform 2. The pushing devices 15 are coupled above the platform 2 to the individual vehicles 6 via the drivers 9.

In this case, the guide track is formed by two rails fixed to the platform at a distance from each other, forming a gap 7, so that the respective drivers 9 can follow the course of the gap 7 of the guide track. Although the guide gap 7 shown in FIG. 1 is circular in shape, other shapes of the guide section, such as oval, triangular or irregular, are preferred. Alternatively, the guide track shown in FIG. 2 is formed by a running rail 14 formed on the base 1, on which runs a running wheel 16 connected to the pushing device 15, which follows the running rail 14 as the drive unit 3 rotates. In this case, the guide track extending in the platform 2 is only a guide gap 7 through which the drivers 9 coupled to the vehicles run.

The vehicles 6 coupled to the drivers 9 have two rear wheels 13, while the front part of each of the vehicles rests on the drivers 9. The drivers 9 also have a vertical extension to which a steering wheel 11 is attached. This allows passengers seated in the vehicles 6 to svivel the vehicle laterally by a pivot angle 10 of, for example, 70° via a rotation of the steering wheel 11 relative to the vehicle while it is moving.

In the sectional view of FIG. 1 shown in FIG. 2, it is shown that the drive unit 3 is mounted in a support bearing 5 on the base 1. The support bearing 5 is located between the base 1 and the platform 2 and forms the axis of rotation of the drive unit 3. This can be motor-driven on the support bearing 5. In an alternative embodiment, the ends of the arms 8 can be attached to an annular support rail 20 (FIG. 4), via which the rotation of the drive unit 3 is effected by means of a friction wheel drive 21 (FIGS. 5, 6). In this case the support bearing 5 is a free running bearing.

On each of the radially directed arms 8 a pushing device 15 is displaceably arranged. Depending on the design of the arms 8, the pushing device 15 is in particular a free-running sleeve, sliding rails coupled to the arms or a sliding carriage. The pushing devices 15 are substantially free to move in the longitudinal direction of the arms. The arms 8, which may also have a curved shape, in particular as a crescent, may be U-sections, beams or frameworks.

The drivers 9 attached to the pushing devices 15 project through guide gaps 7 and are coupled to the vehicles 6 above the platform. When the drive unit 3 rotates, the drivers 9 therefore follow the course of the guide gap 7, and thus the vehicles travel on the platform according to the course of the guide gap.

To support the pushing devices 15 and the arms 8, running wheels 16 are formed, which either engage in the running rail 14 and thereby form the guide track, or are merely support wheels to relieve the weight of the arms.

Passengers can enter and exit platform 2 via entrances and exits 30.

FIG. 3 shows a top view of a vehicle 6 with two seats 12 and wheels 13. Facing the seats 12 is a steering wheel 11 which is arcuate in shape and is fixedly coupled to the driver 9. The passengers can thus turn the vehicle sideways up to a predetermined pivot angle 10 by operating the steering wheel 11.

The operation of the amusement device is as follows: After the passengers have been admitted to the platform, have entered the vehicles and have been secured, the amusement device is set in motion by the drive unit 3 being set in rotation. The individual vehicles 6 follow the gap-shaped guide track 7 or the running rail 14 formed as a support bearing, by means of the drivers 9. If the guide track were concentric about a support bearing 5 arranged centrally on the base, the running path of the vehicles would also be concentric about the support bearing. However, if the support bearing 5 is arranged eccentrically with respect to the base center 4 of the base 1 while the guide track is formed centrically with respect to the base center 4, the pushing devices 15 will move on the respective arms 8 in accordance with the distance between the base center 4 and the support bearing 5 due to the guidance of the drivers on the guide track during the circulation of the drive unit. The circulation path of the vehicles continues to be circular when the guide section is circular, but the distance between successive vehicles changes continuously due to the distance between the support of the driving device and the base center because of shortened or lengthened chordal distances between the respective pushing devices on the arms. Further, if the guide track is not circular in shape but oval, triangular or freeform, the vehicles may follow a path of travel that is unpredictable to passengers and may cover a large area of the platform. If, in addition, the possible swivelling of the vehicles is taken into account and the drive unit is rotated with sufficient speed, strong acceleration and deceleration effects result, which guarantee a great potential for amusement.

In the second embodiment of the invention illustrated in FIGS. 4-8, the amusement device is formed with boats 19 floating in a basin 18. Here, the bottom of the water basin forms the base 1 of the device. In this case, passengers can enter the boats 19 at the rim of the basin after passing through the ticket booth 17, as shown in FIG. 5, and leave the boats 19 again at the rim of the basin after the end of a ride.

In this case, a drive unit 31 substantially corresponding to the drive unit 3 is provided, by means of which the passenger gondolas formed as boats 19 are moved.

FIG. 4 shows a perspective view of such a device. The water basin 18 contains the drive unit 31, which is centrally mounted in a pivot bearing 28 and carries three radially outwardly pointing arms 32, each of which consists of two parallel tubes. The ends of the arms 32 are connected to a circumferential support rail 20, on the side of which friction wheel drives 21 arranged on the circumference of the basin 18 press, the support rail 20 being additionally supported by free-running support wheels 26. The arms 32 are further supported by support rollers on an annular support rail 22 arranged at the bottom of the basin. Alternatively, also in this case the drive of the drive unit 31 may be provided by a central drive instead of the drive by friction wheels.

In this embodiment two boats 19 each are arranged on a triangular-shaped gondola frame 23, which in turn is attached to the respective pushing device 24, which is slidably arranged on the arms 32. In this case, the pushing devices 24 are preferably controlled by pneumatic actuators or alternatively by hydraulic, rack and pinion, chain, cable or electric actuators, whereas the control may be programmed. It is also possible to manually control the displacement of the pushing devices, so that any travel paths can be realized. For a simple operation of the amusement device, predetermined profiles of the movement sequence can be set up for the program-controlled operation, which can control the displacement of the pushing devices in a location-dependent and/or time-dependent manner. A mechanically designed guide via a driver running in a guide track in accordance with the first embodiment is not required in this case. However, even if the amusement device is designed as a water basin, a fixed guide section can be used which is located on the bottom of the water basin.

FIG. 5 shows a top view of the device in a position where passengers can enter or leave the boats. Here, all boats 19 are at the rim of the basin 18 so that passengers can enter or leave the boats dry. This position of the boats is achieved by the respective pushing devices 24 having moved the boats to the rim of the basin, and drive rollers 33 having aligned the boats with the rim of the basin.

FIG. 6 shows the device in a position in which the boats 19 move in the water according to the control by the pushing devices. Since the boats are each arranged in pairs on gondola frames 23 and the gondola frames 23, in addition to being moved on the arms 32 via the pushing devices 24, can also be pivoted or rotated over a large angle in accordance with the travel path 25 by means of rotary actuators 27 located on the pushing devices 24, there are innumerable patterns of movement of the boats in the water.

The rotation resp. pivoting of the gondola frames is effected by the boats being attached, as shown in FIG. 7, to sleeve-shaped displacement devices 39 and 40 which run, on the one hand, on arms 37 and 38 connected to the rotary device 27 and, on the other hand, on a circumferential rail 29 of the gondola frame 23. When the rotary drive 27 is actuated, the displacement devices 39 and 40 and the boats attached thereto thus move along the rail 29 of the gondola frame 23.

The gondola frame 23 itself can be rotated or pivoted relative to the arm 32 in a simple manner by inserting a push rod 35 between a joint 34 on the gondola frame and a joint 36 on the arm 32, as shown in FIGS. 5 and 6. There it is shown that in the condition in which a pushing device 24 has guided a gondola frame 23 to the rim of the basin, the push rod is substantially parallel to the arm 32, whereas in the condition of FIG. 6 the push rod has pivoted the gondola frame by a certain angle.

It may also be provided that the boats can perform minor vertical movements by the support rails 20 having a vertical profiling, the arms 32 being vertically pivotable in the bearing 28. If the profiling is stepped, the boats can in this way cause a sudden strong displacement of water with splashing effects.

Finally, the boats 19 may be rotatable about a vertical axis relative to the gondola frame. This can be controlled by the passengers themselves via a steering wheel, if the passenger gondolas are designed such that the passengers sit opposite each other in the gondolas.

In a further embodiment of the second example, it may also be provided that the boats are pivotable to some extent about one or two horizontal axes to achieve the appearance of actual free floating boats moving freely in the water.

| Reference symbols | |
|---|---|
| 1 | base |
| 2 | platform |
| 3 | drive unit |
| 4 | base center |
| 5 | support bearing |
| 6 | vehicle |
| 7 | guide gap |
| 8 | arms |
| 9 | driver |
| 10 | pivot angle |
| 11 | steering wheel |
| 12 | seats |
| 13 | wheels |
| 14 | running rail |
| 15 | pushing device |
| 16 | wheel |
| 17 | ticket booth |
| 18 | basin |
| 19 | boats |
| 20 | support rail |
| 21 | friction wheel drive |
| 22 | support rail |
| 23 | gondola frame |
| 24 | pushing device |
| 25 | travel path |
| 26 | support wheel |
| 27 | rotary actuator |
| 28 | pivot bearing |
| 29 | rail |
| 30 | entrance and exit |
| 31 | drive unit |

-continued

| Reference symbols | |
|---|---|
| 32 | arms |
| 33 | drive rollers |
| 34 | joint |
| 35 | push rod |
| 36 | joint |
| 37 | arm |
| 38 | arm |
| 39 | displacement device |
| 40 | displacement device |

The invention claimed is:

1. An amusement device for fun fairs or amusement parks, comprising a substantially circular plane base (1) on which a star-shaped drive unit (3, 31) with radially extending arms (8) is arranged which is rotatably mounted on a support bearing (5, 28) of the base (1), and at least one passenger gondola is arranged on each arm (8) of the drive unit (3, 31), characterized in that one or more of the passenger gondolas arranged on the arms (8, 32) are displaceable in the radial direction of the drive unit (3, 31) by means of respective pushing devices (15, 24) each displaceably arranged in the longitudinal direction of the arms (8, 32), the respective passenger gondolas being coupled to the respective pushing devices (15, 24) for radial displacement, and in that the pushing devices (15, 24) follow a predetermined guide track (7, 14) during the circulation of the drive unit (3, 31) on the base (1), so that the passenger gondolas follow a circulation path on the base (1) which corresponds to the course of the guide track (7, 14).

2. An amusement device according to claim 1, characterized in that the guide track (7, 14) is concentric with the base (1).

3. An amusement device according to claim 2, characterized in that the guide track (7, 14) is shaped circumferentially circular, oval, or triangular.

4. An amusement device according to claim 1, characterized in that the drive unit (3, 31) is eccentrically mounted on the base (1).

5. An amusement device according to claim 1, characterized in that the respective passenger gondola is rotatably coupled to the pushing device (15, 24) and that the passenger gondola is pivotable or rotatable during the circulation of the amusement device around the base (1) by actuation of a control device (11).

6. An amusement device according to claim 1, characterized in that the respective pushing device (15) contains a driver (9) which, during the rotation of the drive unit (3), engages in the guide track and follows the guide track during the rotation of the drive unit (3).

7. An amusement device according to claim 1, characterized in that the guide track is formed as a running rail (14) on the base (1), the pushing devices (15, 24) following the running rail (14) during circulation on the base (1).

8. An amusement device according to claim 1, characterized in that the pushing devices (15, 24) are displaceable on the respective arm (8) by means of pneumatic, hydraulic, chain, rack and pinion or electric drive.

9. An amusement device according to claim 8, characterized in that the base (1) forms the bottom of a water basin (18) and that the passenger gondolas are formed as floatable boats (19), the passenger gondolas being conveyed to the rim of the basin at the beginning or end of a ride of the amusement device to allow the passengers entrance or exit.

10. An amusement device according to claim 1, characterized in that the base (1) forms the bottom of a water basin (18) and that the passenger gondolas are formed as floatable boats (19), the passenger gondolas being conveyed to the rim of the basin at the beginning or end of a ride of the amusement device to allow the passengers entrance or exit.

11. An amusement device according to claim 10, characterized in that the arms (32) of the drive unit (31) are vertically pivotally received at their inner end in the support bearing (5).

12. An amusement device according to claim 11, characterized in that the arms (32) of the drive unit (31) are vertically pivotally supported at their inner end such that the outer ends of the arms can follow a vertically up and down path.

13. An amusement device according to claim 10, characterized in that one or more gondolas are attached to a gondola frame (23) which is connected to the pushing device (15, 24) in a horizontally pivotable or rotatable manner.

14. An amusement device according to claim 10, characterized in that the respective passenger gondola (6, 19) is rotatable about a vertical axis.

15. An amusement device according to claim 1, characterized in that one or more gondolas are attached to a gondola frame (23) which is connected to the pushing device (15, 24) in a horizontally pivotable or rotatable manner.

16. An amusement device according to claim 15, characterized in that the gondola frame (23) is connected via a push rod (35) to a joint (34) on the drive unit (31) in such a way that a pivoting of the gondola frame (23) takes place when the displacement device is displaced.

17. An amusement device according to claim 15, characterized in that the pushing device (24) has a rotary drive (27) with radially directed arms (37, 38), in that the gondolas (19) arranged on the gondola frame can be displaced along a rail (29) of the gondola frame (23) by means of a displacement device (39, 40), in each case one arm (37, 38) of the rotary drive (27) being coupled to a displacement device (39, 40) assigned to a gondola (19).

18. An amusement device according to claim 1, characterized in that the respective passenger gondola (6, 19) is rotatable about a vertical axis.

19. An amusement device according to claim 1, characterized in that the respective passenger gondola (19) is pivotable about a horizontal axis.

20. An amusement device according to claim 1, characterized in that the drive unit (3) is driven by a friction wheel drive (21) on the outer circumference of a circular support rail (20) to which the outer ends of the arms (8, 32) are attached.

* * * * *